US006441559B1

(12) United States Patent
Yamamoto et al.

(10) Patent No.: US 6,441,559 B1
(45) Date of Patent: Aug. 27, 2002

(54) FIELD EMISSION DISPLAY HAVING AN INVISIBLE SPACER AND METHOD

(75) Inventors: Joyce K Yamamoto, Chandler; Chenggang Xie, Phoenix; Johann T. Trujillo, Mesa, all of AZ (US); Robert Adler, Northbrook, IL (US); Peter A. Smith, Chandler, AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/560,971

(22) Filed: Apr. 28, 2000

(51) Int. Cl.[7] ..... G09G 3/10
(52) U.S. Cl. ..... 315/169.1; 313/495
(58) Field of Search ..... 315/169.3, 169.1, 315/169.4; 313/309, 310, 495, 444, 292, 422, 336

(56) References Cited

U.S. PATENT DOCUMENTS

| | | | | |
|---|---|---|---|---|
| 5,532,548 A | | 7/1996 | Spindt et al. | 313/422 |
| 5,548,181 A | | 8/1996 | Jones | 313/309 |
| 5,589,731 A | | 12/1996 | Fahlen et al. | 313/495 |
| 5,614,781 A | | 3/1997 | Spindt et al. | 313/422 |
| 5,650,690 A | | 7/1997 | Haven | 313/422 |
| 5,675,212 A | | 10/1997 | Schmid et al. | 313/422 |
| 5,717,287 A | | 2/1998 | Amrine et al. | 313/495 |
| 5,726,529 A | | 3/1998 | Dean et al. | 313/495 |
| 5,742,117 A | | 4/1998 | Spindt et al. | 313/422 |
| 5,834,891 A | * | 11/1998 | Novich | 313/238 |
| 5,898,266 A | | 4/1999 | Spindt et al. | 313/495 |
| 5,990,613 A | * | 11/1999 | Ageno et al. | 313/292 |
| 5,990,614 A | | 11/1999 | Spindt | 313/495 |
| 6,002,198 A | | 12/1999 | Spindt et al. | 313/292 |
| 6,031,336 A | | 2/2000 | Rumbaugh et al. | |
| 6,075,323 A | * | 6/2000 | Smith et al. | 315/169.1 |
| 6,246,177 B1 | * | 6/2001 | Xie et al. | 313/309 |

FOREIGN PATENT DOCUMENTS

| | | |
|---|---|---|
| WO | WO9816326 | 4/1998 |
| WO | WO 9934390 | 7/1999 |

* cited by examiner

*Primary Examiner*—Haissa Philogene
*Assistant Examiner*—Ephrem Alemu
(74) *Attorney, Agent, or Firm*—Kevin D. Wills; William E. Koch

(57) ABSTRACT

A field emission display (100) includes a cathode assembly (102), an anode plate (104), and a spacer (108), which extends between the cathode assembly (102) and the anode plate (104). The spacer (108) is comprised of a spacer material having a dielectric constant less than 100. A discharging period neutralizes positive electrical charge (244) and renders the spacer (108) invisible to a viewer of the field emission display (100). Operating a field emission display (100) to render a spacer (108) invisible by providing a cathode, assembly (102), an anode plate (104), and a spacer (108) comprised of a spacer material with a dielectric constant less than 100 and neutralizing positive electrical charge (244) on spacer (108).

45 Claims, 5 Drawing Sheets

FIELD EMISSION DISPLAY HAVING AN INVISIBLE SPACER AND METHOD

REFERENCE TO RELATED APPLICATIONS

Related subject matter is disclosed in the following pending U.S. patent applications: (1) "Method for Reducing Charge Accumulation in a Field Emission Display," having application Ser. No. 09/009,233, filed on Jan. 20, 1998 now U.S. Pat. No. 6,075,323, and assigned to the same assignee; (2) "Method for Improving Life of a Field Emission Display," having application Ser. No. 09/364,993, filed on Aug. 2, 1999 now U.S. Pat. No. 6,380,914, and assigned to the same assignee; and (3) "Modified Discharge Scheme for Field Emission Device," filed on the same date herewith, and assigned to the same assignee now U.S. Pat. No. 6,246,177.

FIELD OF THE INVENTION

The present invention pertains to the area of field emission displays and, more particularly, to the area of spacers in field emission displays.

BACKGROUND OF THE INVENTION

It is known in the art to use spacer structures between the cathode and anode of a field emission display. The spacer structures maintain the separation between the cathode and the anode. They must also withstand the potential difference between the cathode and the anode.

However, spacers can adversely affect the flow of electrons toward the anode in the vicinity of the spacer. Some of the electrons emitted from the cathode can cause electrostatic charging of the surface of the spacer, changing the voltage distribution near the spacer from the desired voltage distribution. The change in voltage distribution near the spacer can result in distortion of the electron flow.

In a field emission display, this distortion of the electron flow proximate to the spacers can result in distortions in the image produced by the display. In particular, the distortions render the spacers "visible" by producing either a dark or light region in the image at the location of each spacer.

Several prior art spacers attempt to solve the problems associated with spacer charging. For example, it is known in the art to provide a spacer having a surface which has a sheet resistance that is low enough to remove the impinging electrons by conduction, yet high enough to keep power loss due to electrical current from the anode to the cathode at a tolerable level. The resistive surface can be realized by coating the spacer with a film having the desired resistance. However, these films are susceptible to mechanical damage and/or alteration, such as may occur during the handling of the spacers. They are also susceptible to chemical alteration, which may change their resistivity.

It is also known in the art to provide additional, independently controlled electrodes along the height of the spacer for controlling the voltage distribution near the spacer. However, this prior art scheme includes additional processing steps for forming the spacer electrodes, which are also mechanically susceptible to damage. This prior art scheme also uses additional voltage sources for applying potentials to the spacer electrodes, which may greatly increase the complexity and cost of the device.

Accordingly, there exists a need for an improved field emission device, which has spacers that reduce distortion of electron flow and that do not result in excessive power losses.

BRIEF DESCRIPTION OF THE DRAWINGS

Referring to the drawings.

Figure 1:
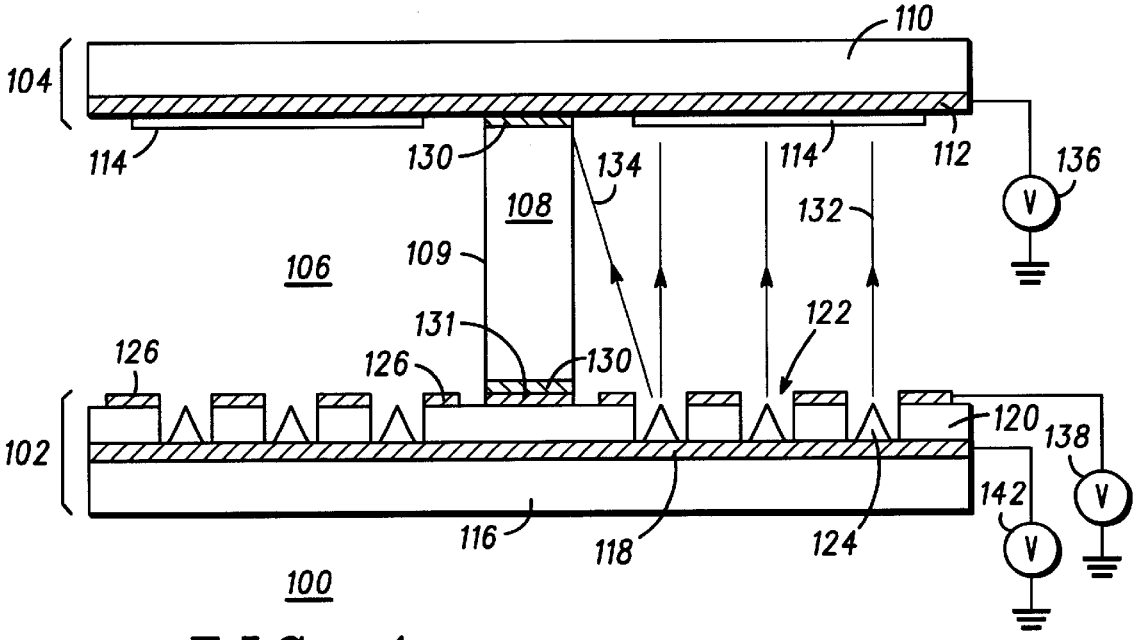
FIG. 1 is a cross-sectional view of a field emission display in accordance with an embodiment of the invention.

It will be appreciated that for simplicity and clarity of illustration, elements shown in the FIGURES have not necessarily been drawn to scale. For example, the dimensions of some of the elements are exaggerated relative to each other.

DESCRIPTION

An embodiment of the invention concerns a field emission display having a spacer, where the dielectric constant of the spacer material is selected to limit the voltage change on the surface of the spacer, and when coupled with a spacer discharging period is able to maintain spacer invisibility to a viewer of the field emission display. An embodiment of the method of the invention includes the steps of providing a cathode assembly and an anode plate disposed to receive electrons. A spacer is provided between the cathode assembly and the anode plate. The field emission display is operated such that the spacer accumulates positive electrical charge during a charging period and neutralizes the positive electrical charge during a discharging period. The dielectric constant of the spacer is selected to limit the positive charge accumulation on the spacer. The embodiments of the invention have the advantage of reducing the distortion of electron flow proximate to the spacer to an extent sufficient to render the spacer invisible to a viewer of the field emission display.

The invention takes advantage of the fact that matrix-based display devices, including field emission display devices, are generally addressed one line at a time. For example, a field emission display device contains a plurality of gate electrodes and a plurality of cathode conductors, which define an array of individually addressable pixels. Each gate electrode defines one horizontal row, and each cathode conductor defines one vertical column. The operation of the field emission display device includes activating one row at a time (i.e., all gates in that row are driven positive), while electrical signals appropriate to the desired light distribution in that particular row are applied to the cathode conductors. If the field emission display contains, for example, 240 rows, each row is active during only 1/240 of the total time; the rest of the time it remains inactive. Typically, the active period ranges from about 30 to about 100 microseconds, depending upon the number of rows and upon the frame rate. The inactive period lasts between 13,000 and 20,000 microseconds.

With prior art spacers, the electrostatic charging process previously described produces adverse potential distributions on the spacer surface within the first few microseconds of the active period of each row. During the remainder of the active period, the electron flow remains distorted, and a dark region appears at the location of the spacer.

However, for a spacer in accordance with the invention, the growth of an adverse potential distribution is slowed down in inverse relation the capacitance of the spacer. In accordance with the invention, utilizing spacer materials of a selected dielectric constant, K, (where $K=e/e_0$ (e=absolute permittivity of spacer material and $e_0$=permittivity of vacuum which is equal to $8.85\times10^{-12}$ farad/meter, and for a parallel plate capacitor $K=Ct/e_0A$, where C is the capacitance, t is the material thickness between the plates and A is the surface area in contact with the plates) a capacitance of the spacer is selected that prevents the excessive growth of electron flow distortion during the active period of 30 to 100 microseconds. When the active period for a given row ends, the charging process also stops, and the full frame time of many thousands of microseconds becomes available to dispose of the accumulated charge.

Expressed somewhat differently, the selected dielectric constant of the spacer material results in a controlled low rate of increase of the voltage on the surface of the spacer. The controlled rate of increase of the voltage limits the cumulative change in voltage at the spacer during the emission time of the electron emitters proximate to the spacer. The controlled voltage increase results in reduced distortion of the electron flow. In one embodiment of the invention, the field emission device is a field emission display having spacers, which are invisible to a viewer of the field emission display. By controlling the distortion of the electron flow, a field emission display in accordance with the invention maintains the desired activation of phosphors proximate to the spacers.

FIG. 1 is a cross-sectional view of a field emission display (100) in accordance with an embodiment of the invention. FED 100 has a cathode assembly 102, which opposes an anode plate 104. An evacuated region 106 exists between cathode assembly 102 and anode plate 104. The pressure within evacuated region 106 is about $10^{-6}$ Torr. A spacer 108 having a surface 109 extends between cathode assembly 102 and anode plate 104. Spacer 108 provides mechanical support to maintain the separation between cathode assembly 102 and anode plate 104. Spacer 108 has features that ameliorate distortion of the flow of an electron current 132 proximate to spacer 108. In the embodiment of the invention, spacer 108 further has features that render it invisible to a viewer of FED 100 during its operation.

Cathode assembly 102 includes a substrate 116, which can be made from glass, silicon, and the like. Upon substrate 116 is disposed a cathode conductor 118, which can include a thin layer of molybdenum. A dielectric layer 120 is formed on cathode conductor 118. Dielectric layer 120 can be made from, for example, silicon dioxide. Dielectric layer 120 defines a plurality of emitter wells 122, in which are disposed one each of a plurality of electron emitters 124. In the embodiment of FIG. 1, electron emitters 124 include Spindt tips.

However, a device in accordance with the invention is not limited to Spindt tip electron sources. Electron emitters for use in a device in accordance with the invention include thermionic electron emitters, photocathode electron emitters, field emission electron emitters, and the like. These types of electron emitters are known to one skilled in the art. For example, another useful type of field emission electron emitter is an electron-emissive carbon film. It is desired to be understood that the invention can be embodied by a cathodoluminescent display device having electron emitters other than Spindt tip field emission electron emitters. In general, the cathodoluminescent display device is operated one line at a time so as to define a charging period for each spacer.

Cathode assembly 102 further includes a plurality of gate electrodes 126, which are used to selectively address the electron emitters 124.

Anode plate 104 includes a transparent substrate 110, upon which is disposed an anode 112, which can include a thin layer of indium tin oxide. A plurality of phosphors 114 is disposed upon anode 112. Phosphors 114 oppose electron emitters 124.

A first voltage source 136 is connected between anode 112 and ground. A second voltage source 138 is connected between plurality of gate electrodes 126 and ground, and a third voltage source 142 is connected between cathode conductor 118 and ground.

Spacer 108 extends between cathode assembly 102 and anode plate 104. One end of spacer 108 contacts anode plate 104, at a surface that is not covered by phosphors 114; the opposing end of spacer 108 contacts cathode assembly 102, at a portion that does not define emitter wells 122. Although FIG. 1 illustrates a single spacer 108, the invention encompasses any number of spacers within a field emission display 100.

In accordance with the invention, spacer 108 is comprised of a material that is selected to reduce the distortion of the trajectory of electron current 132 proximate to spacer 108. In an embodiment of the invention, the spacer material is provided so that the distortion of the trajectory of electron current 132 is controlled to an extent sufficient to render spacer 108 invisible to a viewer of FED 100 during its operation.

In the embodiment FIG. 1, a spacer conductor 130 is provided between spacer 108 and anode plate 104 and spacer 108 and cathode assembly 102. Spacer conductor 130 is provided to avoid the occurrence of large electric fields where spacer 108 interfaces with anode plate 104 and cathode assembly 102, due to microscopic roughness of the surface 109 of spacer 108 in those regions. Spacer conductor 130 is made from a convenient conductive material, such as chromium, aluminum, gold, and the like. In another embodiment, a cathode charge conductor 131 is provided between spacer 108 and cathode assembly 102. Cathode charge conductor 131 is provided as a landing pad on the cathode assembly 102 for spacer 108 and can be connected to electrical ground or to one of the plurality of gate electrodes 126. Cathode charge conductor 131 is made from a convenient conductive material, such as molybdenum, aluminum, and the like.

An embodiment of a field emission device in accordance with the invention will now be described with reference to FIG. 1. It is desired to be understood that a device embodying the invention is not limited to this configuration. This exemplary configuration is useful for operation of FED 100 at a potential difference between cathode assembly 102 and anode plate 104, which is greater than about 300 volts, and preferably within a range of about 3000–5000 volts. It also includes a VGA configuration.

In the embodiment of FIG. 1, spacer 108 is a rectangular platelet, which has a length (into the page) of about 5 millimeters, a height (extending between cathode assembly 102 and anode plate 104) of about 1 millimeter, and a thickness of about 0.07 millimeters. The center-to-center distance between the plurality of gate electrodes 126 is about 0.3 millimeters.

In general, the aspect ratio (ratio of height to thickness) of spacer 108 is determined by variables such as the potential difference between cathode assembly 102 and anode plate 104, by the separation distance between adjacent gate electrodes 126 and mechanical strength of the spacer. The height of spacer 108 is selected to be sufficient to prevent electrical arcing between cathode assembly 102 and anode plate 104. The separation distance between adjacent gate electrodes 126 is determined by the desired resolution of the display.

While the geometry of spacer 108 is affected by the above factors, the dielectric constant of the spacer material can be manipulated to provide the desired charge-potential characteristics of the spacer. Thus, in the embodiment of FIG. 1, the dielectric constant of the spacer material is selected to control the potential rise at spacer 108, so that any resulting distortion of the trajectory of electron current 132 due to the electrical charging of spacer 108 is not visibly discernable to a viewer of FED 100.

In general, the suitability of the spacer material is determined by several variables. These variables encompass both structural and electrical considerations. As a structural element of the FED 100, spacer material must have mechanical properties suitable to both stand-off the anode plate 104 and cathode assembly 102 and to provide the necessary strength to enable fabrication of spacers of appropriate geometry, including Young's Modulus, tensile strength, density, and the like. Electrical properties include the dielectric constant of the spacer material, the conductivity and surface charge mobility of the spacer material, the secondary electron yield of the spacer material and the geometry of spacer 108. Any combination of these variables can be manipulated to realize an embodiment of the invention with dielectric constant being the most influential.

There is a critical range of spacer material properties that strike a balance between the varied and diverse requirements of a suitable spacer material. The intrinsic spacer material characteristics required for both high structural strength and high dielectric strength are short bonds, tightly held bonding electrons and low bond electronic polarizability. The intrinsic characteristics required of a spacer material for increased dielectric constant are in direct contrast to the above requirements for structural strength and high dielectric breakdown strength. These include long bonds, loosely held bonding electrons and high bond electronic polarizability. In general, higher dielectric constant materials have lower intrinsic dielectric breakdown strength. In other words, in a field emission display as the dielectric constant increases, there is a greater chance that the spacer material will breakdown causing arcing between the cathode assembly 102 and anode plate 104 and rendering the FED 100 inoperable. Therefore, it is believed that there is an upper limit on the dielectric constant of spacer material in order for it to be suitable for use in a field emission display.

In an embodiment of the invention, spacer 108 has a dielectric constant, K, which is less than 100. Preferably, the dielectric constant is in a range from 60 to less than 100. Most preferably, the dielectric constant is between 80 and 85. Exemplary spacer materials for use in the embodiment of the invention include niobate materials, tantalate materials, titanate materials, zirconate materials, and the like.

Useful titanate materials include compositions within the $LnO—TiO_2$ binary system, where Ln can include Group IIA cations (e.g. magnesium, calcium, strontium, barium), and the like, in either single or mixed cation systems, for example $(Sr,Ca)TiO_3$, and the like. In other words, Ln includes at least one of a group IIA cation. Exemplary rare earth titanates include compositions within the $Re_2O_3—TiO_2$ binary system wherein Re is a rare earth trivalent cation (e.g. La, Sm, Pr, Nd), and the like. Exemplary zirconates include compositions within the $LnO—ZrO_2$ binary system, where Ln can include Group IIA cations (e.g. magnesium, calcium, strontium, barium), and the like. Exemplary tantalates include compositions within the $LnO—BaO—Ta_2O_5$ ternary system, where Ln can include Mg, Zn, and the like. Exemplary niobate materials include compositions in the $Bi_2O_3—NiO—ZnO—Nb_2O_5$systems, for example, zinc bismuth niobate ($Bi_2(ZnNb)O_9$), nickel bismuth niobate ($Bi_2(NiNb)O_9$), and the like.

An embodiment of the invention is neodymium barium titanate, which can contain any one, or some fraction of, the following three phases: a first phase of $BaNd_2Ti_5O_{14}$, a second phase of $NdTiO_3$, and a third phase of $Nd_2Ti_2O_7$ where there also may be traces of TiO2 present. In another embodiment of the invention, the first phase can be $BaSm_2Ti_5O_{14}$. The mixture is then processed using conventional ceramic powder processing techniques to form a dense ceramic body from which a spacer 108 is then fabricated. A variety of methods known to those skilled in the art can be used to form the dense ceramic body from which spacer 108 is fabricated, for example, dry pressing under applied high pressure, tape casting, roll compaction, and the like. Small amounts of dopants can be added to spacer material to serve as densification aids.

It is desired to be understood that the above spacer materials are exemplary and that the invention can be embodied by spacer materials other than those described above that have the selected dielectric constant. For example, for situations where the number of electrons hitting the spacers is less (e.g. small spacer surface area compared to electron emitter dimensions), low resolution displays where the separation distance between the spacer and the emitters is large, and the like, the selected dielectric constant of the spacer material can be smaller in order to achieve the object of the invention. Suitable materials can include, for example, sapphire, glass, alumina, silicon nitride, aluminum nitride, silicon carbide, zirconium oxide, glass ceramic materials, silicate based materials, and the like.

In order to provide a field emission display 100 with an acceptable lifetime and to maintain spacer invisibility in accordance with the invention, it is desirable that the dielectric constant of the spacer material should be maintained as constant as possible over the operating temperature range of FED 100. In other words, it is desirable that the dielectric constant of the spacer material should possess a low temperature coefficient of dielectric constant (TCK). In accordance with an embodiment of the invention, the spacer material is selected such that the dielectric constant of the spacer material varies by less than 20% over the operating temperature range of FED 100. By maintaining dielectric constant variations within this range, spacer breakdown is ameliorated and spacer invisibility is maintained.

It is desirable to minimize the dielectric loss at the frequency of operation of FED 100. Low dielectric loss minimizes conversion of electrical energy into heat, which prevents thermal breakdown of the spacer material. Low dielectric loss also minimizes dielectric constant variations due to loss induced temperature variations.

For example, in an embodiment of the invention, for an FED with a rare earth titanate spacer material with a dielectric constant of 83, an operating frequency of approximately 60 Hz and an operating temperature range of approximately 30 to 200° F., a dielectric constant shift of approximately ±1% is observed while maintaining spacer invisibility.

During the operation of FED 100, potentials are applied to plurality of gate electrodes 126, cathode conductor 118, and anode 112 to cause selected electron emission at electron emitters 124 and to direct the electrons through evacuated region 106 toward phosphors 114. Phosphors 114 are caused to emit light by the impinging electrons. Typically, the plurality of gate electrodes 126 of FED 100 are sequentially addressed. As each gate electrode is addressed, a voltage is applied to each of the cathode conductors. Each gate electrode is addressed for a period of time referred to as the active period or "line time." The entirety of gate electrodes within FED 100 is addressed during a frame. The time required to address once each of the gate electrodes within FED 100 is referred to as the "frame time."

During the frame time, when electron emitters 124 proximate to spacer 108 are caused to emit electrons, some of these electrons impinge upon spacer 108, as indicated by an arrow 134 in the FIG. 1. These impinging electrons cause electrostatic charging and changes in the potential at the surface 109 of spacer 108 as well as regions surrounding spacer 108. The induced surface charge can be non-uniform due to the distribution of electron trajectories from emitters 124. Because the spacer material has a secondary electron yield of greater than one, the surface 109 of spacer 108 emits more than one electron for each electron received. Thus a positive electrical charge is developed on the surface 109 of spacer 108. In general, during the frame time of FED 100, there is a period of time, the charging period, during which the surface 109 of spacer 108 is becoming electrostatically charged, and there is a period of time, the quiescent period, which is equal to the remainder of the frame time, not including the charging period.

The dielectric constant of spacer material is provided to control the rate of change of the potentials at the surface 109 of spacer 108. The controlled rate of change of the surface potentials results in reduced distortion of the trajectory of electron current 132, so that the desired activation of phosphors 114 is maintained. The controlled rate of change of the surface potentials also results in reduced incremental charge accumulation at spacer 108, which reduces the charge dissipation requirements. Specifically, the dielectric constant is selected so that the potential changes at the surface 109 of spacer 108 during the charging period are low enough to prevent undesirable distortion of the flow of electron current 132 proximate to spacer 108.

This is accomplished by minimizing the rate of voltage change on the surface 109 of spacer 108 as governed by the following relationship:

$$\frac{dV}{dt} \propto \Gamma(\gamma - 1)I_p / K$$

where:

dV/dt=rate of voltage change on surface of spacer $I_p$=electron current impinging on spacer K=dielectric constant Γ=geometric factor related to parameters such as distance between electron emitter and spacer, spacer height, and the like γ=secondary electron yield Increasing the dielectric constant decreases the rate of voltage change on the surface of spacer, while reducing the secondary electron yield allows the use of a lower dielectric constant spacer material for the same decrease in rate of voltage change.

Another electrical property of the spacer material that determines spacer performance is the conductivity and surface charge mobility of the charged specie. It is important to distinguish between conductivity and surface charge mobility of the spacer material in order to achieve a spacer material consistent with the objective of the invention and render spacer 108 invisible to a viewer of the field emission display 100. The conductivity of the spacer material is composed of a bulk contribution and a surface contribution. The bulk contribution holds off the anode voltage and minimizes power consumption. The surface contribution is defined as: $\sigma=(\mu)^*(\eta)$, where σ=surface conductivity ($ohm^{-1}$), μ=surface charge mobility ($cm^2/V^*sec$), and η=free charge density ($C/cm^2$) available in the material. Since the intrinsic density of free charge carriers is small in insulating materials, for example, spacer materials, the conductivity is small, enabling the ability of spacer 108 to hold off the high voltage between cathode assembly 102 and anode plate 104.

In an embodiment of the invention, electrons 134 impinge on spacer 108, generating secondary electrons and inducing a net positive electrical charge on the surface 109 of spacer 108. A discharging cycle, described below, releases electrons to neutralize the positive electrical charge on the surface 109 of spacer 108. Charge density in the spacer material under electron bombardment, know as injected charge, is now higher than the intrinsic charge density, resulting in localized areas of higher injected charge conductivity This is described as $\sigma_T=\sigma_I+\sigma_C$, where $\sigma_T$=total surface conductivity, $\sigma_I=(\mu)^*(\eta_I)$ and $\sigma_C=(\mu)^*(\eta_C)$, where $\eta_I$ is the intrinsic surface charge density and $\eta_C$ is the injected charge density. Therefore, the quantity $(\mu)^*(\eta_C)$ is the additional conductivity generated by the injected charge. In an unirradiated condition, $\sigma_C=0$, since $\eta_C=0$. When $\sigma_C$ is nonzero, $\sigma_C>\sigma_I$.

The added conductivity ($\sigma_C>0$) is not enough to cause arching or shorting between the cathode assembly 102 and anode plate 104 since the bulk conductivity still dominates due to the localized nature of the injected charge. The higher conductivity of the spacer material after the discharging cycle enables any additional negative charge to bleed off of the surface 109 of spacer 108. Once the excess charge is dissipated, the conductivity due to the injected charge returns to zero.

From the above analysis it can be seen that the selected value of the dielectric constant depends upon the value of the electron current 132 impinging upon spacer 108. In general, the dielectric constant required increases with increasing impinging electron current 134.

After plurality of gate electrodes 126 proximate to spacer 108 have been addressed, there is a period of time during the given frame time in which the remaining gate electrodes of FED 100 are addressed, and spacer 108 is not impinged by electrons. During this quiescent period, the accumulated charge can be discharged by one of a variety of methods.

Figure 2:
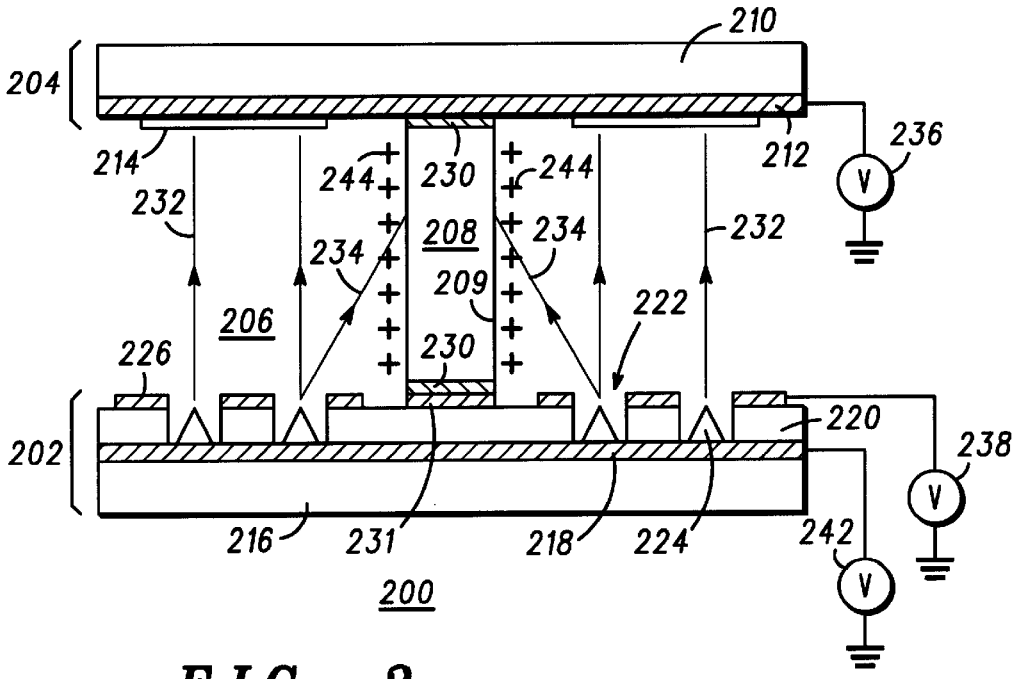
FIG. 2 is a cross-sectional view of a field emission display in accordance with an embodiment of the method of the invention.

An embodiment of the method of the invention is shown in FIGS. 2–5. FIG. 2 is a cross-sectional view of a field emission display 200 in accordance with an embodiment of the method of the invention. FIG. 2 includes the elements of FED 100 (FIG. 1), which are similarly referenced, beginning with a "2." During the frame time, when electron emitters 224 proximate to spacer 208 are caused to emit electrons, some of these electrons impinge upon spacer 208, as indicated by an arrow 234 in FIG. 2. These impinging electrons cause electrostatic charging, and changes in the potential at the surface 209 of spacer 208 as described above. Thus a positive electrical charge 244 is developed on the surface 209 of spacer 208. Due to limited surface charge mobility, most of the positive electrical charge 244 remains on the surface 209 of spacer 208 until discharged as explained below.

Figure 3:
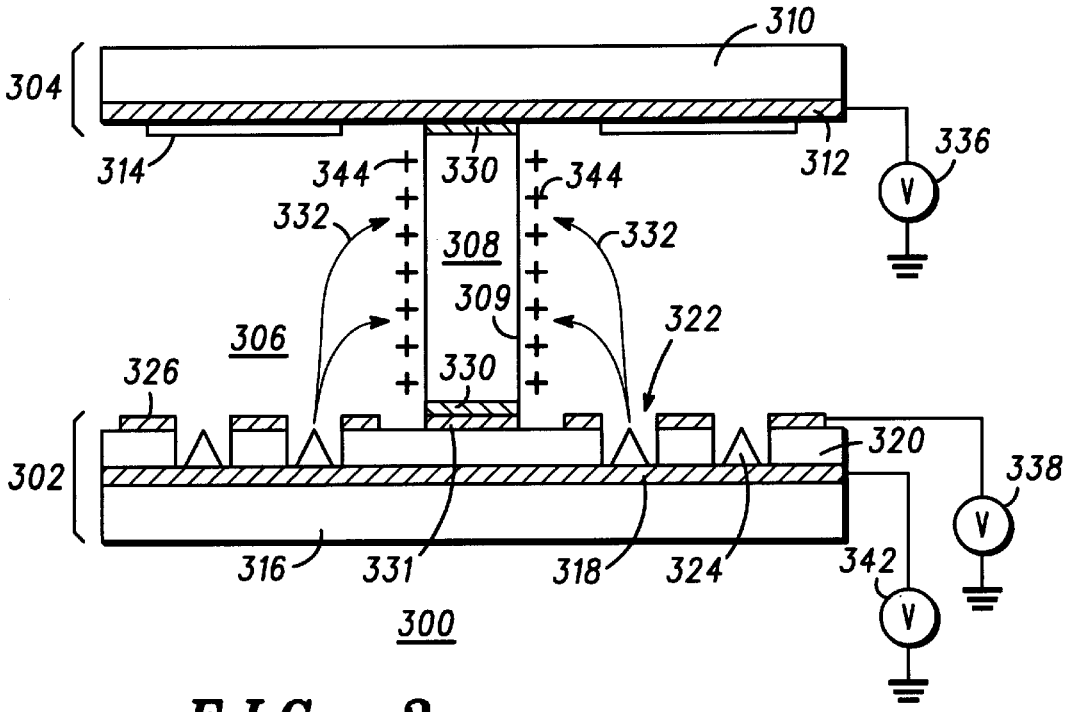
FIG. 3 is a cross-sectional view of a field emission display in accordance with an embodiment of the method of the invention.

FIG. 3 is a cross-sectional view of a field emission display 300 in accordance with an embodiment of the method of the invention. FIG. 3 includes the elements of FED 200 (FIG. 2), which are similarly referenced, beginning with a "3." In accordance with an embodiment of the invention, FIG. 3 illustrates a method of neutralizing the positive electrical charge 344 on the surface 309 of spacer 308 by providing a discharging period. During the discharging period, the positive electrical charge 344 accumulated on the surface 309 of spacer 308 can be substantially neutralized by activating, during each frame time, some or all of electron emitters 324. In this manner, electrons are emitted into evacuated region 306 and are made available to substantially neutralize the positive electrical charge 344 on the surface 309 of spacer 308. During this neutralization step, the potential at anode 312 is dropped to a value substantially below the potential at the surface 309 of spacer 308, so that the electrons are attracted toward spacer 308 and not toward anode 312. The number and configuration of electron emitters 324, which are caused to emit electrons during the neutralization step, are selected to effect the desired neutralization. In an exemplary neutralization step, only a portion of electron emitters 324 that are proximate to spacer 308 are activated. In another exemplary neutralization step, all electron emitters 324 that are proximate to the spacer 308 are activated.

In the preferred embodiment, the discharging period occurs at the end of the frame time. However, other suitable timing schemes can be employed. For example, the discharging period can occur at a time other than the end of the frame time. In another example, the discharging period can occur after multiple frame times have been executed.

Figure 4:
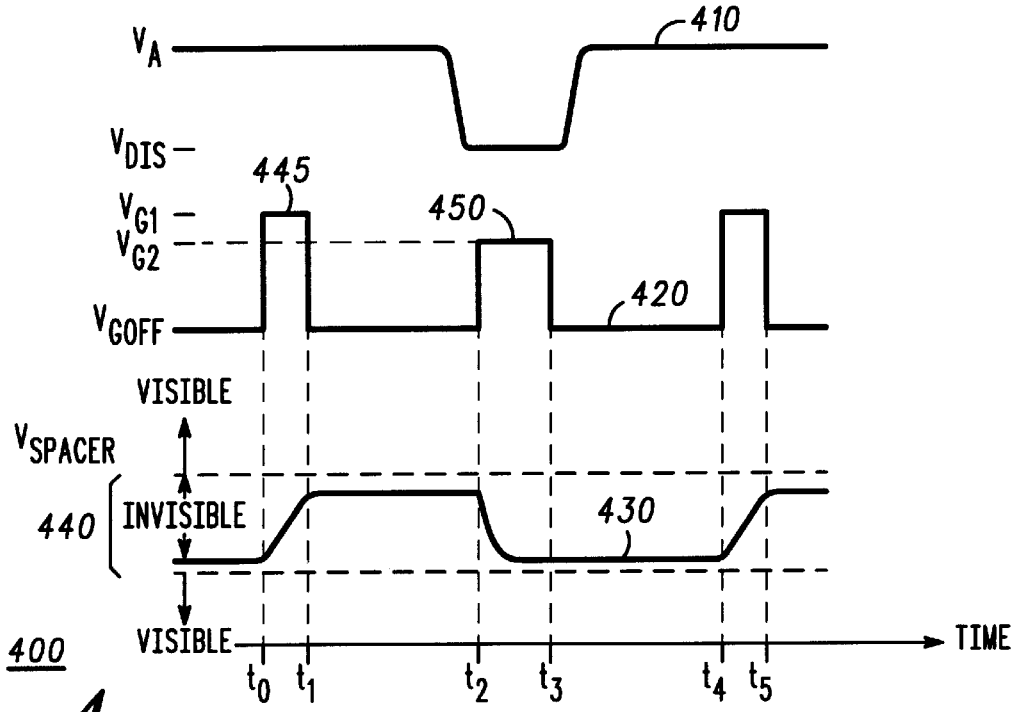
FIG. 4 is a timing diagram illustrating a method for operating a field emission display in accordance with an embodiment of the invention illustrated in FIGS. 2–3.

FIG. 4 is a timing diagram 400 illustrating a method for operating a field emission display in accordance with an embodiment of the invention illustrated in FIGS. 2–3. Timing diagram 400 represents electron emitters 124 generally adjacent to spacer 108. Timing diagram 400 depicts the anode voltage 410, the gate electrode voltage 420 and a spacer voltage graph 430. The spacer voltage graph 430 represents the voltage, $V_{SPACER}$, at one point on the surface 309 of spacer 308 during a frame time.

The operation of field emission display 200, 300 is characterized by the repetition of a sequence of steps. One of these cycles, the frame time, is represented in the timing diagram 400 between times $t_0$ and $t_4$. In accordance with the invention, each frame time includes a first charging period, which is represented by timing diagram 400 between times t and $t_1$, and a discharging period, which is represented by timing diagram 400 between times $t_2$ and $t_3$. The beginning of a second frame time coincides with the beginning of a second charging period, which is represented in the timing diagram 400 by time $t_4$, with the second charging period being represented between times $t_4$ and $t_5$.

During the first charging period, the surface 209 of spacer 208 accumulates a positive electrical charge 244, which is represented in timing diagram 400 in the spacer voltage graph 430 between times $t_0$ and $t_1$ as an increase in $V_{SPACER}$. This happens when plurality of gate electrodes 226 corresponding to electron emitters 224 located proximate spacer 208 are addressed, which is represented in gate electrode voltage 420 by a charging period pulse 445, $V_{G1}$. During the discharging period, electron current 332 substantially neutralizes the positive electrical charge 344 on the surface 309 of spacer 308, which is represented in the spacer voltage graph 430 between times $t_2$ and $t_3$.

As illustrated in FIG. 4, the discharging mode of operation includes the step of reducing the anode voltage 410 from an active period value, $V_A$, to a discharging period value, $V_{DIS}$. After anode voltage 410 has been reduced, plurality of gate electrodes 326 corresponding to electron emitters 324 proximate to spacer 308 are addressed, which is represented in gate electrode voltage 420 by a discharging pulse 450, $V_{G2}$. This causes electron emitters 324 to emit electron current 332 and substantially neutralize positive electrical charge 344 on surface 309 of spacer 308. $V_{G2}$ can be any voltage required to obtain the desired emission current from plurality of electron emitters 324, for example, 80 volts, 100 volts, and the like. $V_{G2}$ is not necessarily equal to $V_{G1}$ in either magnitude or pulse width. In one embodiment of the invention, $V_{G2}$ has a magnitude and pulse width $(t_3-t_2)$ equal to $V_{G1}$. In another embodiment, $V_{G2}$ has either a magnitude not equal to $V_{G1}$ or a pulse width not equal to $V_{G1}$. In yet another embodiment, $VG_2$ has both a magnitude and pulse width not equal to $V_{G1}$. In accordance with the invention, the discharging pulse 450 has a magnitude and pulse width such that the electron current 332 substantially neutralizes positive electrical charge 344 such that voltage change on the surface 309 of spacer 308 is low enough to maintain spacer 308 in the invisible range 440.

As illustrated in FIG. 4, the method of the invention keeps the voltage change on the surface 309 of the spacer 308 in the invisible range 440. In other words, the voltage change on the surface 309 of spacer 308 is low enough to prevent distortion of the trajectory of the electron current 332 proximate to spacer 308 to an extent sufficient to render the spacer 308 invisible to the viewer of the field emission display 300.

Figure 5:
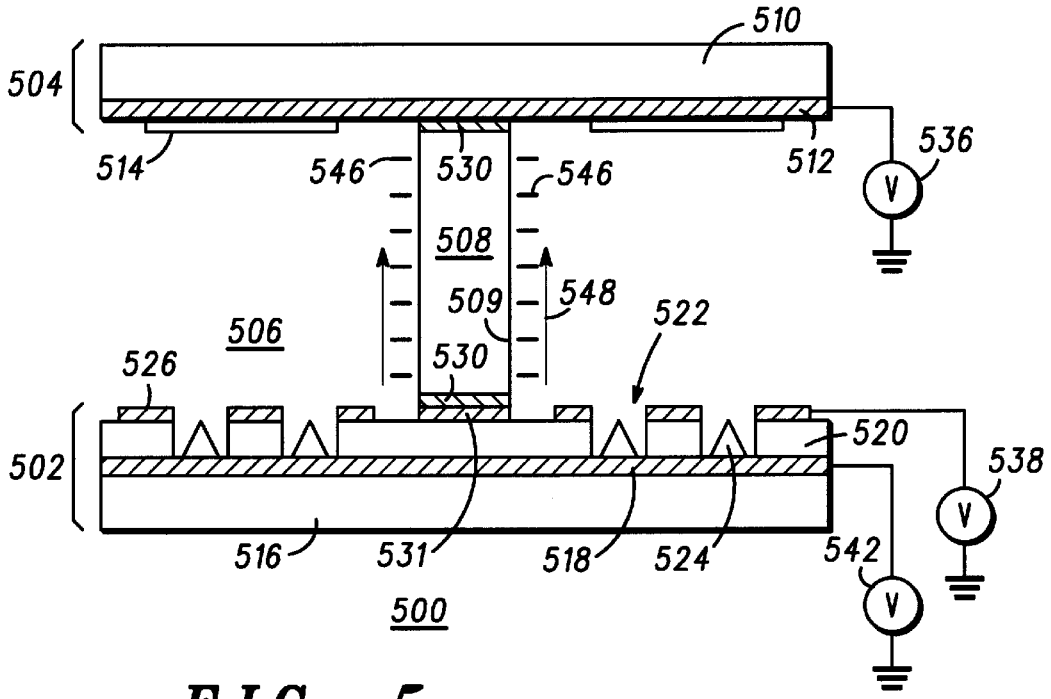
FIG. 5 is a cross-sectional view of a field emission display in accordance with another embodiment of the method of the invention.

FIG. 5 is a cross-sectional view of a field emission display 500 in accordance with another embodiment of the method of the invention. FIG. 5 includes the elements of FED 300 (FIG. 3), which are similarly referenced, beginning with a "5." The present embodiment of the invention incorporates those steps illustrated in FIGS. 2–3 with respect to charging the surface 509 of spacer 508 with positive electrical charge 344 during a first charging period and thereafter discharging the positive electrical charge 344 during a discharging period. However, in the present embodiment of the invention shown in FIG. 5, a negative electrical charge 546 accumulates on the surface 509 of spacer 508 at the end of the discharging period due to excessive electron current 332 above that required to neutralize positive electrical charge 344. In the present embodiment of the invention, the spacer material has a charge density and corresponding surface conductivity such that negative electrical charge 546 is substantially dissipated, as represented by arrows 548, through surface conduction prior to the beginning of the second charging period. In an embodiment of the invention, a surface conductivity of the spacer material in the range of $10^{-9}$ to $10^{-12}(\text{ohm})^{-1}$ is preferable.

Figure 6:
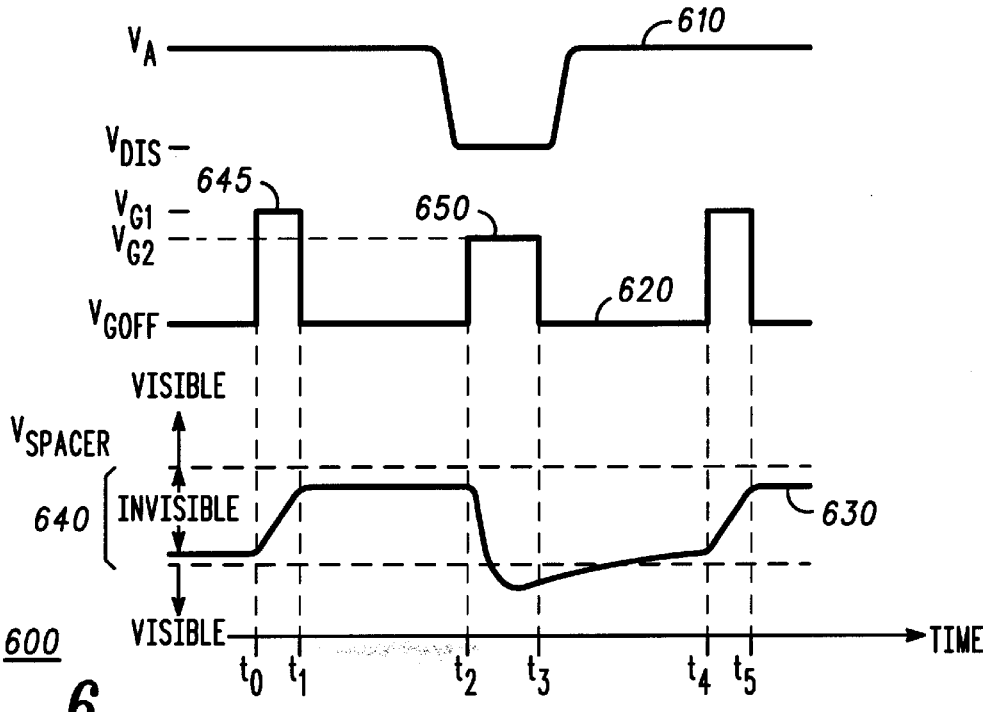
FIG. 6 is a timing diagram illustrating a method for operating a field emission display in accordance with another embodiment of the invention illustrated in FIGS. 2–3 and 5.

FIG. 6 is a timing diagram 600 illustrating a method for operating a field emission display in accordance with another embodiment of the invention illustrated in FIGS.

2–3 and 5. FIG. 6 includes the elements of FIG. 4, which are similarly referenced, beginning with a "6." The operation of field emission display 200, 300, 500 is similar to the embodiment described with reference to FIGS. 2–4 except that a negative electrical charge 546 accumulates on the surface 509 of spacer 508 at the end of discharging period. This is due to excessive electron current 332 as illustrated in the spacer voltage graph 630 where the voltage on the surface 509 of spacer 508 falls below the invisible range 640. If negative electrical charge 546 on the surface 509 of spacer 508 were to remain, spacer 508 would likely become visible to a viewer of the FED 500 during second charging period and subsequent charging periods. To prevent the accumulation of excess negative electrical charge 546, the magnitude and pulse width $(t_3-t_2)$of the discharging period pulse 645, $V_{G2}$, can be reduced. However, in accordance with the present embodiment of the invention, excess negative electrical charge 546 may still accumulate on the surface 509 of spacer 508. In the embodiment of the invention, negative electrical charge 546 is dissipated prior to second charging period, which is represented in timing diagram 600 between times $t_4$ and $t_5$. Therefore, the method of the invention maintains the voltage change on the surface 509 of the spacer 508 within the invisible range 640. In other words, the voltage change on the surface 509 of spacer 508 is low enough to prevent distortion of the trajectory of the electron current 332 proximate to the spacer 508 to an extent sufficient to render the spacer 508 invisible to the viewer of the field emission display 500.

The positive electrical charge accumulated on the surface of spacer can be discharged using a variety of methods. Prior art methods of providing the discharging period, include reducing or "pulling-down" the anode voltage to approximately ground potential in order for the electron current to neutralize the charged surfaces within a field emission display. For example, U.S. Pat. No. 6,031,336 issued Feb. 29, 2000; and U.S. patent application Ser. No. 09/009,233 filed on Jan. 20, 1998, is now U.S. Pat. No. 6,075,233 allowed on Mar. 30, 1999 and assigned to the same assignee, are directed towards methods of pulling down anode voltage to ground potential during a discharging period and are hereby incorporated by reference.

Figure 7:
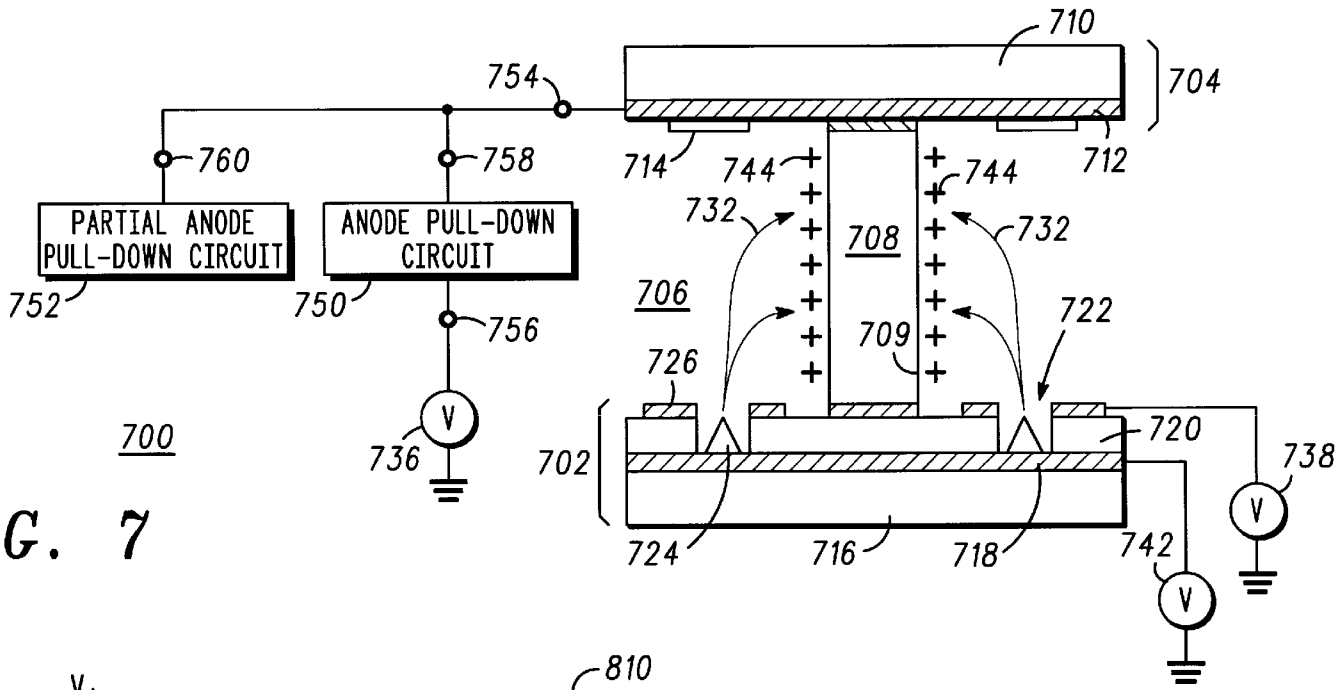
FIG. 7 is a cross-sectional view of a field emission display in accordance with yet another embodiment of the invention.

FIG. 7 is a cross-sectional view of a field emission display 700 in accordance with yet another embodiment of the invention. FIG. 7 includes the elements of FED 300 (FIG. 3), which are similarly referenced, beginning with a "7." FED 700 includes an anode pull-down circuit 750 with an output 758 connected to the input 754 of anode 712. An input 756 of anode pull-down circuit 750 is connected to first voltage source 736. In order to provide a more efficient FED 700 and still provide a discharging period for spacer charge neutralization and invisibility, a partial anode pull-down circuit 752 is included in FED 700. The output 760 of partial anode pull-down circuit is connected to the input 754 of anode 712.

Figure 8:
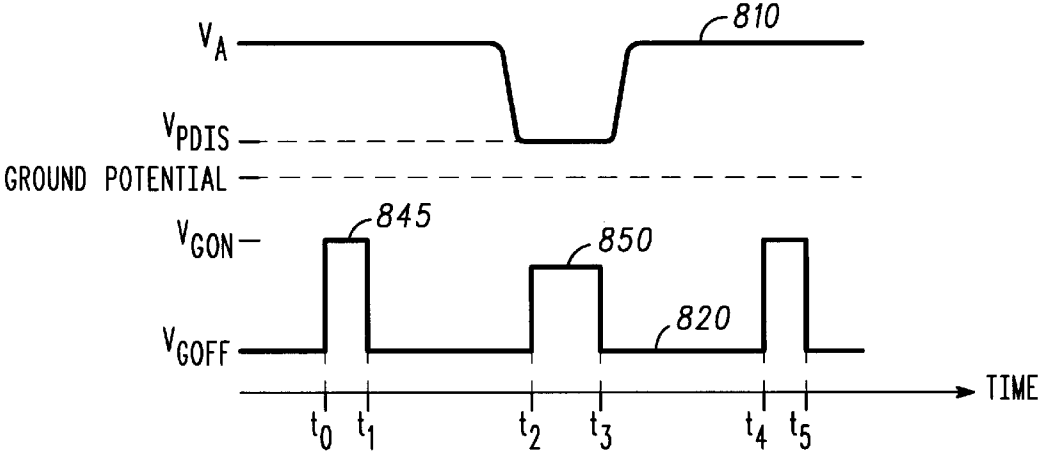
FIG. 8 is a timing diagram illustrating a method for operating a field emission display in accordance with yet another embodiment of the invention.

FIG. 8 is a timing diagram 800 illustrating a method for operating a field emission display in accordance with yet another embodiment of the invention. FIG. 8 includes the elements of FIG. 6, which are similarly referenced, beginning with an "8." While the anode pull-down circuit 750 operates as shown in the incorporated references, the partial anode pull-down circuit 752 operates to drop the anode voltage from an active period value, $V_A$, to a discharge value, $V_{DIS}$, where the discharge value is above ground potential. The discharge value of anode voltage 810 can be, for example, in the range of 100 to 400 volts above ground potential. In an embodiment of the invention, a spacer dielectric constant in the range of 80 to 85 and a geometry of spacer 708 as described above, a discharge voltage, $V_{DIS}$, in the range of 200 to 300 volts above ground potential is found useful to maintain the voltage on the surface 709 of spacer 708 within the invisible range 640. In other words, the voltage change on the surface 709 of spacer 708 is low enough to prevent distortion of the trajectory of the electron current 732 proximate to the spacer 708 to an extent sufficient to render the spacer 708 invisible to the viewer of the field emission display 700.

Figure 9:
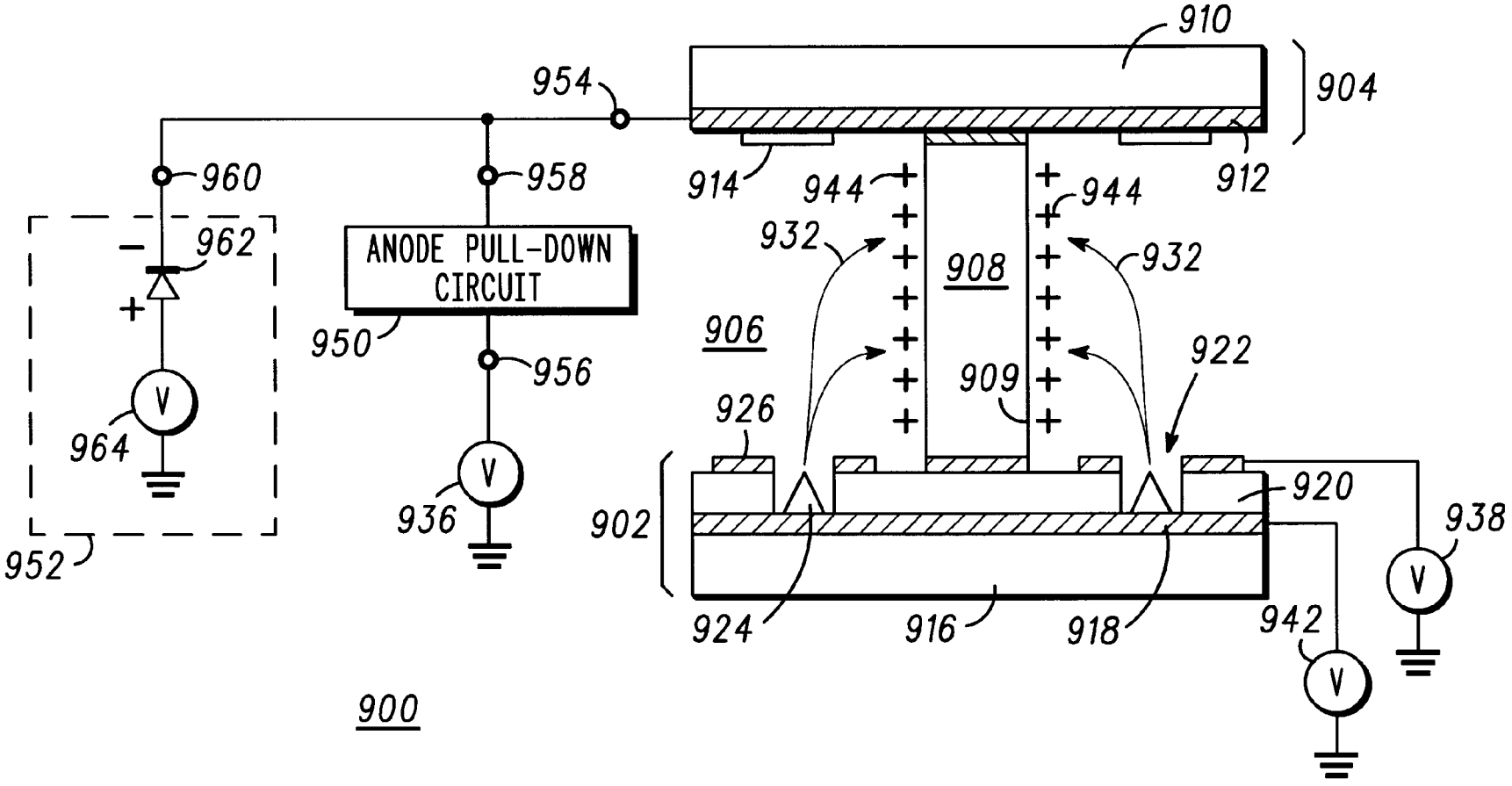
FIG. 9 is a cross-sectional view of a field emission display in accordance with still yet another embodiment of the invention.

FIG. 9 is a cross-sectional view of a field emission display 900 in accordance with still yet another embodiment of the invention. FIG. 9 includes the elements of FED 700 (FIG. 7), which are similarly referenced, beginning with a "9." FIG. 9 includes an embodiment of partial anode pull-down circuit 952, which comprises a fourth voltage source 964 and a diode 962 connected in series to the output 960 of partial anode pull-down circuit 952. The output 960 of partial anode pull-down circuit 952 is connected to the input 954 of anode 912. The value of fourth voltage source 964 is chosen to correspond with the desired value of discharge voltage, $V_{DIS}$.

In operation, the FED 900 of FIG. 9 uses the anode pull-down circuit 950 to pull down the anode voltage 810 during the discharging period. However, the partial anode pull-down circuit 952 operates to keep anode voltage 810 above ground potential. When anode voltage 810 reaches the value of fourth voltage source 964, partial anode pull-down circuit 952 operates to keep anode voltage 810 at the desired value of discharge voltage, $V_{DIS}$, above ground potential during the discharging period. By not cycling anode voltage 810 between active period value, $V_A$, and ground potential, a more power efficient FED 900 is provided.

The anode pull-down and discharge circuits and methods shown in FIGS. 7–9 are only exemplary and the invention is not limited to the embodiments shown. It is desired to be understood that the invention can be embodied through the utilization of other discharge circuits and methods. For example, U.S. patent application entitled "Modified Discharge Scheme for Field Emission Device" filed on the same date herewith and assigned to the same assignee.

In summary, an embodiment of the invention concerns a field emission display having a spacer, comprised of a spacer material with a dielectric constant selected to maintain spacer invisibility to a viewer of the field emission display when coupled with a spacer discharging period. A method of the invention includes providing a field emission display with spacers comprised of a spacer material with a dielectric constant selected such that operating the field emission display with a spacer discharging period renders the spacers invisible to a viewer of the field emission display. The embodiments of the invention have the advantage of ameliorating electron flow distortion due to the presence of spacers and rendering the spacers invisible to a viewer of the field emission device. While we have shown and described specific embodiments of the present invention, further modifications and improvements will occur to those skilled in the art. We desire it to be understood, therefore, that this invention is not limited to the particular forms shown, and we intend in the appended claims to cover all modifications that do not depart from the spirit and scope of this invention.

What is claimed is:

1. A field emission display comprising:

a cathode assembly having a plurality of electron emitters, wherein the plurality of electron emitters are designed to emit an electron current;

an anode plate disposed to receive the electron current emitted by the plurality of electron emitters; and a spacer comprised of a bulk spacer material and having a surface, thespacer extending between the cathode assembly and the anode plate, wherein the bulk spacer material has a dielectric constant less than 100, wherein the spacer has a first charging period and a discharging period associated therewith, wherein the first charging period is characterized by accumulation of a positive electrical charge on the surface of the spacer resulting in a resistivity at the surface that is lower than the resistivity of the bulk spacer material during the first charging period, and wherein the discharging period is characterized by the electron current substantially neutralizing the positive electrical charge on the surface of the spacer with an anode voltage at a level below a potential at the surface of the spacer and wherein activation of a plurality of electron emitters positioned proximate the spacer during neutralization are controlled to avoid excessive electron emission, such that a controlled voltage change on the surface of the spacer is low enough to prevent distortion of the trajectory of the electron current proximate to the spacer to an extent sufficient to render the spacer invisible to a viewer of the field emission display.

2. The field emission display as claimed in claim 1, wherein the spacer material has a dielectric constant from 60 to less than 100.

3. The field emission display as claimed in claim 2, wherein the spacer material has a dielectric constant from 80 to 85.

4. The field emission display as claimed in claim 1, wherein the spacer material is further comprised of a material being selected from a group consisting of niobates, zirconates, tantalates, and titanates.

5. The field emission display as claimed in claim 4, wherein the spacer material is further comprised of a titanate material within a LnO—$TiO_2$ binary system, wherein Ln is at least one of a group IIA cation.

6. The field emission display as claimed in claim 4, wherein the spacer material is further comprised of a rare earth titanate material within a $Re_2O_3$—$TiO_2$ binary system, wherein Re is a rare earth trivalent cation.

7. The field emission display as claimed in claim 4, wherein the spacer material is further comprised of a zirconate material within a LnO—$ZrO_2$ binary system, wherein Ln is a group IIA cation.

8. The field emission display as claimed in claim 4, wherein the spacer material is further comprised of a tantalate material within a LnO—BaO—$Ta_2O_5$ ternary system, wherein Ln is selected from the group consisting of Zn and Mg.

9. The field emission display as claimed in claim 4, wherein the spacer material is further comprised of a niobate material selected from the group consisting of zinc bismuth niobate and nickel bismuth niobate.

10. The field emission display as claimed in claim 4, wherein the spacer material is further comprised of a neodymium barium titanate, wherein the neodymium barium titanate is comprised of at least one phase selected from the group consisting of a first phase of $BaNd_2Ti_5O_{14}$, a second phase of $NdTiO_3$, and a third phase of $Nd_2Ti_2O_7$.

11. The field emission display as claimed in claim 1, wherein the discharging period is characterized by the accumulation of a negative electrical charge on the surface of the spacer.

12. The field emission display as claimed in claim 11, wherein the spacer material has a surface conductivity and a second charging period associated therewith, and wherein the surface conductivity is such that the negative electrical charge on the spacer is substantially dissipated prior to the second charging period.

13. The field emission display as claimed in claim 12, wherein the surface conductivity of the spacer material is from $10^{-9}$–$10^{-12}(\text{ohm})^{-1}$.

14. The field emission display as claimed in claim 1, further comprising an operating temperature range of the field emission display, and wherein the dielectric constant of the spacer material varies by less than 20% over the operating temperature range.

15. The field emission display as claimed in claim 1, wherein the spacer further has a gate electrode discharging pulse having a magnitude and pulse width associated therewith, and wherein the magnitude and the pulse width are such that the electron current substantially neutralizes the positive electrical charge on the surface of the spacer.

16. A method of rendering a spacer invisible to a viewer of a field emission display comprising:

providing a cathode assembly having a plurality of electron emitters, wherein the plurality of electron emitters are designed to emit an electron current;

providing an anode plate disposed to receive the electron current emitted by the plurality of electron emifters;

providing a spacer comprised of a bulk spacer material and having a surface, the spacer extending between the cathode assembly and the anode plate, wherein the bulk spacer material has a dielectric constant lees than 100; and operating the field emission display such that the spacer has a first charging period and a discharging period associated therewith, wherein the first charging period is characterized by the accumulation of a positive electrical charge on the surface of the spacer resulting in a resistivity at the surface that is lower than the resistivity of the remaining bulk spacer material during the first charging period, and wherein the discharging period is characterized by the electron current substantially neutralizing the positive electrical charge on the surface of the spacer by decreasing the anode voltage to below a potential at the surface of the spacer and controlling activation of a plurality of electron emitters positioned proximate the spacer during neutralization to avoid excessive electron emission, such that a controlled voltage change on the surface of the spacer is low enough to prevent distortion of the trajectory of the electron current proximate to the spacer to an extent sufficient to render the spacer invisible to the viewer of the field emission display.

17. The method of claim 16, wherein the step of operating the field emission display further comprises the step of operating the field emission display such that the discharging period is characterized by the accumulation of a negative electrical charge on the surface of the spacer.

18. The method of claim 17, wherein the step of providing the spacer further comprises the steps of:

providing a second charging period; and providing the spacer material with a surface conductivity such that the negative electrical charge on the surface of the spacer is substantially dissipated prior to the second charging period.

19. The method of claim 18, wherein the step of providing the spacer further comprises the step of providing the surface conductivity from $10^{-9}$–$10^{-12}(\text{ohm})^{-1}$.

20. The method of claim 16, wherein the step of providing the spacer further comprises the step of providing the spacer material having a dielectric constant from 60 to less than 100.

21. The method of claim 20, wherein the step of providing the spacer further comprises the step of providing the spacer material having a dielectric constant from 80 to 85.

22. The method of claim 16, wherein the step of providing the spacer farther comprises the step of providing the spacer wherein the spacer material comprises a material being selected from a group consisting of niobates, zirconates, tantalates, and titanates.

23. The method of claim 22, wherein the step of providing the spacer further comprises the step of providing the spacer wherein the spacer material is her comprised of a titanate material within a LnO—$TiO_2$ binary system, wherein Ln is at least one of a group IIA cation.

24. The method of claim 22, wherein the step of providing the spacer further comprises the step of providing the spacer wherein the spacer material is further comprised of a rare earth titanate within a $Re_2O_3$—$TiO_2$ binary system, wherein Re is a rare earth trivalent cation.

25. The method of claim 22, wherein the step of providing the spacer further comprises the step of providing the spacer wherein the spacer material is further comprised of a zirconate material within a LnO—$ZrO_2$ binary system, wherein Ln is a group IIA cation.

26. The method of claim 22, wherein the step of providing the spacer further comprises the step of providing the spacer wherein the spacer material is further comprised of a tantalate material within a LnO—BaO—$Ta_2O_5$ ternary system, wherein Ln is selected from the group consisting of Zn and Mg.

27. The method of claim 22, wherein the step of providing the spacer further comprises the step of providing the spacer wherein the spacer material is further comprised of a niobate material selected from the group consisting of zinc bismuth niobate and nickel bismuth niobate.

28. The method of claim 22, wherein the step of providing the spacer further comprises the step of providing the spacer wherein the spacer material is further comprised of neodymium barium titanate, wherein the neodymium barium titanate is comprised of at least one phase selected from the group consisting of a first phase of $BaNd_2Ti_5O_{14}$, a second phase of $NdTiO_3$, and a third phase of $Nd_2Ti_2O_7$.

29. The method of claim 16, further providing an operating temperature range of the field emission display, and wherein the dielectric constant of the spacer material varies by less than 20% over the operating temperature range.

30. The method of claim 16, wherein the step of operating the field emission display further includes providing a gate electrode discharging pulse having a magnitude and pulse width, and wherein the magnitude and the pulse width are such that the electron current substantially neutralizes the positive electrical charge on the surface of the spacer.

31. A method of controlling a voltage change on a spacer in a field emission display comprising:

providing a cathoding assembly having a plurality of electron emitters, wherein the plurality of electron emitters are designed to emit an electron current;

providing an anode plate having a phosphor, wherein the phosphor is disposed to receive the electron current emitted by the plurality of electron emitters;

providing a spacer composed of a bulk material having a surface, the spacer extending between the cathode assembly and the anode plate, wherein the bulk spacer material has a dielectric constant less than 100; and operating the field emission display such that the spacer has a first charging period and a discharging period associated therewith, wherein the first charging period is characterized by the accumulation of a positive electrical charge on the surface of the spacer, and wherein the discharging period is characterized by the electron current substantially neutralizing the positive electrical charge on the surface of the spacer by decreasing the anode voltage to below a potential at the surface of the spacer to ensure the electrons are attracted to the spacer surface and activating a plurality of electron emitters positioned proximate the spacer during neutralization to avoid excessive ectron emission, such that a controlled voltage change on the surface of the spacer is low enough to prevent distortion of the trajectory of the electron current proximate to the spacer to an extent sufficient to render the spacer invisible to the viewer of the field emission display.

32. The method of claim 31, wherein the step of operating the field emission display further comprises the step of operating the field emission display such that the discharging period is characterized by the accumulation of a negative electrical charge on the surface of the spacer.

33. The method of claim 32, wherein the step of providing the spacer further comprises the steps of:

providing a second charging period; and providing the spacer material with a surface conductivity such that the negative electrical charge on the surface of the spacer is substantially dissipated prior to the second charging period.

34. The method of claim 33, wherein the step of providing the spacer further comprises the step of providing the surface conductivity from $10^{-9}$–$10^{-12}(ohm)^{-1}$.

35. The method of claim 31, wherein the step of providing the spacer further comprises the step of providing the spacer material having a dielectric constant from 60 to less than 100.

36. The method of claim 35, wherein the step of providing the spacer further comprises the step of providing the spacer material having a dielectric constant from 80 to 85.

37. The method of claim 31, wherein the step of providing the spacer further comprises the step of providing the spacer wherein the spacer material comprises a material being selected from a group consisting of niobates, zirconates, tantalates, and titanates.

38. The method of claim 37, wherein the step of providing the spacer further comprises the step of providing the spacer wherein the spacer material is further comprised of a titanate material within a LnO—$TiO_2$ binary system, wherein Ln is at least one of a group IIA cation.

39. The method of claim 37, wherein the step of providing the spacer further comprises the step of providing the spacer wherein the spacer material is further comprised of a rare earth titanate material within a $Re_2O_3$—$TiO_2$ binary system, wherein Re is a rare earth trivalent cation.

40. The method of claim 37, wherein the step of providing the spacer further comprises the step of providing the spacer wherein the spacer material is further comprised of a zirconate material within a LnO—$ZrO_2$ binary system, wherein Ln is a group IIA cation.

41. The method of claim 37, wherein the step of providing the spacer further comprises the step of providing the spacer wherein the spacer material is further comprised of a tantalate material within a LnO—BO-a$Ta_2O_5$ ternary system, wherein Ln is selected from the group consisting of Zn and Mg.

42. The method of claim 37, wherein the step of providing the spacer further comprises the step of providing the spacer wherein the spacer material is further comprised of a niobate material selected from the group consisting of zinc bismuth niobate and nickel bismuth niobate.

43. The method of claim 37, wherein the step of providing the spacer further comprises the step of providing the spacer wherein the spacer material is further comprised of neodymium barium titanate, wherein the neodymium barium titanate is comprised of at least one phase selected from the group consisting of a first phase of $BaNd_2Ti_5O_{14}$, a second phase of $NdTiO_3$, and a third phase of $Nd_2Ti_2O_7$.

44. The method of claim 31, further providing an operating temperature range of the field emission display, and wherein the dielectric constant of the spacer material varies by less than 20% over the operating temperature range.

45. The method of claim 31, wherein the step of operating the field emission display further includes providing a gate electrode discharging pulse having a magnitude and pulse width, and wherein the magnitude and the pulse width are such that the electron current substantially neutralizes the positive electrical charge on the surface of the spacer.

* * * * *